United States Patent [19]

Burdick

[11] Patent Number: 4,514,292

[45] Date of Patent: Apr. 30, 1985

[54] FROTH FLOTATION PROCESS

[75] Inventor: Charles L. Burdick, Wilmington, Del.

[73] Assignee: Hercules Incorporated, Wilmington, Del.

[21] Appl. No.: 550,163

[22] Filed: Nov. 9, 1983

[51] Int. Cl.[3] ..... B03D 1/14

[52] U.S. Cl. ..... 209/167

[58] Field of Search ..... 209/167, 166

[56] References Cited

U.S. PATENT DOCUMENTS

| | | | |
|---|---|---|---|
| 1,678,259 | 7/1928 | Martin . | |
| 2,130,574 | 9/1938 | Breerwood | 209/167 |
| 2,286,374 | 6/1942 | Ray | 209/166 |
| 2,442,455 | 6/1948 | Booth et al. | 209/166 |
| 2,446,207 | 8/1948 | Bishop | 209/166 |
| 2,471,384 | 5/1949 | Booth et al. | 209/167 |
| 2,485,083 | 10/1949 | Booth et al. | 209/166 |
| 3,912,623 | 10/1975 | Buza et al. | 209/167 |
| 3,919,080 | 11/1975 | Stauter | 209/167 |
| 4,113,106 | 9/1978 | Obinata et al. | 209/167 |
| 4,172,029 | 10/1979 | Hefner, Jr. | 209/166 |
| 4,192,739 | 3/1980 | Wang et al. | 209/166 |
| 4,199,065 | 4/1980 | Wang et al. | 209/166 |
| 4,308,133 | 12/1981 | Meyer | 209/166 |

FOREIGN PATENT DOCUMENTS

| | | | |
|---|---|---|---|
| 213672 | 10/1980 | German Democratic Rep. | 209/166 |
| 45758 | 3/1983 | Japan | 209/166 |
| 152439 | 4/1961 | U.S.S.R. | 209/167 |

OTHER PUBLICATIONS

Chemical Abstract 108806f, Separation of Bulk Molybdenum Containing Concentrates, vol. 69, 1968.

*Primary Examiner*—Bernard Nozick
*Attorney, Agent, or Firm*—Hazel L. Deming

[57] ABSTRACT

The froth flotation of ore and coal is significantly improved in recovery and grade of valuable minerals and coal when a depressant combination of an inorganic sulfite and the salts of certain sulfonated compounds are employed.

8 Claims, No Drawings

FROTH FLOTATION PROCESS

This invention relates to the beneficiation of ores and coal by the froth floatation process and more particularly to a froth floatation process which uses a novel depressant for associated gangue and ash-producing constituents.

The reagents used in the froth flotation of ores or coal are of three general types, namely, frothing agents, collecting agents and modifying agents. Frothing agents depress the surface tension of the water employed and thus facilitate the formation of air bubbles when the water is aerated. Collectors serve to modify the surfaces of the ore or coal particles and cause them to adhere to the air bubbles which are formed in water. Modifying agents are used to modify the ore pulp so that the desired minerals will be collected in the froth and the remainder will not. Modifiers which prevent the flotation of a particular material are commonly referred to as depressing agents or depressants.

Depressing agents which have been employed in the past in the flotation of minerals include inorganic reagents such as lime, sodium and potassium cyanide, sodium sulfate, sodium sulfite, sodium sulfide, sulfur dioxide, potassium and sodium dichromate, sodium silicate and trisodium dithiophosphate, and natural polymeric substances such as starch, dextrin, gums, cellulose derivatives and the like. The effectiveness of the prior art reagents to depress gangue minerals associated with many ore types, however, is limited and the need exists for depressants having good selectivity as well as superior performance.

Now, in accordance with this invention it has been found that significant improvement in recovery and grade of valuable minerals or coal can be achieved by carrying out the froth flotation of ore or coal in the presence of a depressant which consists essentially of the combination of an inorganic sulfite and salts of certain sulfonated compounds.

Accordingly this invention relates to a froth flotation process for separating metallic minerals from their associated gangue and for beneficiating coal wherein the process is carried out in the presence of a water-soluble depressant composition consisting essentially of, by weight, (a) from about 95% to about 5% of at least one alkali metal or ammonium sulfite or bisulfite and (b) from about 5% to about 95% of at least one salt of a sulfonated compound selected from the group consisting of benzene disulfonic acids, naphthalene disulfonic acids, condensates of formaldehyde and naphthalene sulfonic acids, naphthol sulfonic acids, lignin sulfonic acids and sulfonated quebracho.

The preferred sulfite components of the depressant compositions of this invention are sodium sulfite, sodium bisulfite, potassium sulfite, potassium bisulfite and ammonium sulfite.

The sulfonated compounds which have been found to be particularly useful in the depressant compositions of this invention are the alkali metal salts and preferably the disodium salts of the naphthalene disulfonic acids or the naphthol disulfonic acids, the sodium salts of condensates of formaldehyde and naphthalene sulfonates and especially the condensates in which two, three or more naphthalene sulfonate nuclei are joined together by methylene groups in what amounts to a low-degree condensation polymer, and the sodium lignin sulfonates.

The sulfonated compounds described herein are well known in the art and are commercially available.

As indicated above, the depressant consists essentially of from about 95 to about 5 weight % of an alkali metal or ammonium sulfite and a complementary amount of a salt of specified sulfonated compounds. The individual components can be premixed and added to the flotation circuit as a single composition, or the components, in the weight ratio desired, can be separately added to the flotation circuit at the same or different addition points.

One skilled in the art of beneficiating ore or coal by froth flotation will be cognizant of appropriate frothing agents and collectors to obtain optimum results from the flotation of a particular ore. Frothing agents which have been found to be particularly useful are pine oil, alcohols of about 4 to 12 carbon atoms and particularly a mixture of $C_4$ to $C_8$ alcohols, polypropylene glycol ethers, and the like. Suitable collectors include the hydrocarbon oils and particularly the fuel oils represented by diesel oil, kerosene, Bunker C fuel oil and mixtures thereof. Other collectors include the alkali metal xanthates, the dithiophosphates and the like.

The depressant composition described in accordance with this invention can be used generally for the recovery of minerals from sulfide ores, oxides, non-metallic ores and native metals. Coal likewise can be beneficiated by flotation using the depressant of this invention. Usually, and such is preferred, the amount of depressant used will range from about 0.05 to about 1.0 pound and more preferably from 0.1 to 0.3 pound per ton of ore or coal.

The invention is further illustrated by the following examples which demonstrate the best embodiments of the invention. In the examples all percentages are by weight unless otherwise indicated.

EXAMPLE 1

A 1 kilogram sample of porphyry copper ore containing 0.49% copper, chiefly in the form of chalcopyrite, and 0.007% molybdenum was crushed and wet ground to a particle size such that about 80% was minus 65 mesh and about 50% was minus 200 mesh. Water was next added to the ground ore to produce a pulp containing 33% solids. The pulp was adjusted to a pH of 10.5 with lime and transferred to a Denver flotation cell. Next 0.1 pound per ton of ore of a 1:1 mixture of sodium sulfite and 1-naphthol-3,6-disulfonic acid disodium salt as a gangue depressant was added to the pulp and the pulp was conditioned for 1 minute at about 1500 rpms. Finally, 0.04 pound of diethyl dithiophosphate (collector) and 0.02 pound of a commercial alcohol frother, per ton of ore were added to the pulp and the mixture was conditioned for 1 minute. Froth flotation was then carried out for 5 minutes, following which time the concentrate was assayed conventionally.

For the sake of comparisons, the above procedure was repeated except that the depressant was omitted (control) or the depressant was 0.1 pound per ton of ore of sodium sulfite (comparative example, 1-A) or 0.1 pound of 1-naphthol-3,6-disulfonic acid disodium salt (comparative example, 1-B). The flotation test results for this example, the control and comparative examples 1-A and 1-B are set forth in Table 1, below.

EXAMPLE 2

The procedure of Example 1 was repeated except that the amount of depressant was 0.2 pound per ton of ore. The flotation test results for this example, its control and comparative examples 2-A and 2-B are set forth in Table 1.

TABLE 1

| | Flotation Concentrate | | | | |
|---|---|---|---|---|---|
| | Assay | | | Recovery | |
| Ex. | Cu (%) | Mo (%) | Insolubles (%) | Cu (%) | Mo (%) |
| 1 | 13.3 | 0.124 | 17.1 | 91.5 | 54.8 |
| 1-A | 12.6 | 0.083 | 22.2 | 92.7 | 47.4 |
| 1-B | 12.6 | 0.083 | 21.5 | 91.5 | 44.4 |
| Control | 11.7 | 0.082 | 23.1 | 92.6 | 46.2 |
| 2 | 13.7 | 0.119 | 14.9 | 91.8 | 52.1 |
| 2-A | 13.0 | 0.089 | 23.1 | 92.7 | 49.2 |
| 2-B | 12.9 | 0.079 | 21.6 | 92.7 | 45.6 |
| Control | 12.7 | 0.110 | 21.6 | 90.9 | 50.7 |

EXAMPLE 3

The procedure of Example 1 was repeated except that the ore sample contained 0.50% copper as chalcocite and 0.021% molybdenum. Test results are set forth in Table 2.

EXAMPLE 4

The procedure of Example 3 was repeated except that the amount of depressant was 0.2 pound per ton of ore. The test results are set forth in Table 2.

TABLE 2

| | Flotation Concentrate | | | | |
|---|---|---|---|---|---|
| | Assay | | | Recovery | |
| Ex. | Cu (%) | Mo (%) | Insolubles (%) | Cu (%) | Mo (%) |
| 3 | 21.0 | 0.674 | 22.6 | 90.2 | 68.1 |
| 3-A | 20.7 | 0.487 | 25.6 | 91.0 | 60.2 |
| 3-B | 19.5 | 0.488 | 26.0 | 90.9 | 61.8 |
| Control | 19.9 | 0.570 | 28.5 | 90.0 | 59.2 |
| 4 | 21.9 | 0.712 | 22.8 | 89.8 | 65.9 |
| 4-A | 20.1 | 0.453 | 27.7 | 90.4 | 59.9 |
| 4-B | 20.5 | 0.475 | 26.1 | 91.2 | 60.3 |
| Control | 19.1 | 0.468 | 28.8 | 90.8 | 61.2 |

EXAMPLE 5

The general procedure of Example 1 was carried out using a porphyry ore sample assaying 0.4% copper and, at the dosage level of 0.1 pound per ton of ore, a 9:1 mixture of sodium sulfite and 1-naphthol-3,6-disulfonic acid disodium salt. In this Example a 1:1 mixture of sodium sulfite and a commercial sulfonated alpha olefin consisting essentially of mixed $C_{14}$–$C_{16}$ monosulfonates was used as the comparative example, 5-C. The comparative mixture, 5-C caused excessive foaming which resulted in a substantial reduction in concentrate grade and hence non-acceptability. Test results are set forth in Table 3.

TABLE 3

| | Flotation Concentrate | |
|---|---|---|
| Ex. | Assay, % Cu | Recovery, % Cu |
| 5 | 15.0 | 63.4 |
| 5-C | 2.84 | 79.7 |
| Control | 10.5 | 61.0 |

EXAMPLE 6

A sample of bituminous coal having a particle size of minus 28 mesh was slurried in water and transferred to a Denver flotation cell. The sample was conditioned for 1 minute at 1200 rpms with 0.1 pound per ton of coal of a 9:1 mixture of sodium sulfite and the sodium salt of a condensate of 3 moles of sulfonated naphthalene and 2 moles of formaldehyde, the condensate having a molecular weight of about 800, as depressant. Next, 0.3 pound per ton of coal of an alcohol frother was added to the cell and conditioning was carried out for 1 minute. Froth flotation was then carried out for 2 minutes at 1200 rpms, following which time the concentrate was dried, weighed and ashed to determine % combustibles.

For the sake of comparisons, the above procedure was repeated except that the depressant was omitted (control) or the depressant was 0.1 pound per ton of coal of sodium sulfite (comparative example, 6-A) or 0.1 pound per ton of coal of the sodium salt of the sulfonated naphthalene/formaldehyde condensate (comparative example, 6-B). The flotation test results for this example, the control and comparative examples 6-A and 6-B are set forth in Table 4.

EXAMPLE 7

A 100 gram sample of highly oxidized, dry slush pond anthracite coal fines was slurried in water in a Denver flotation cell and the pH was adjusted in 7.0 with lime. Next 0.1 pound per ton of coal of a 1:9 mixture of sodium sulfite and the sodium salt of the condensate of Example 6 was added as depressant and the slurry was conditioned for 1 minute at 1200 rpms. Then, per ton of coal, 1.5 pounds of modified No. 2 fuel oil and 0.2 pound of methylisobutyl carbinol frothing agent were added and conditioning was carried out for 1 minute. Froth flotation was then carried out for 3 minutes, after which time the concentrate was dried, weighed and ashed. Flotation test results for this example, its control and comparative examples 7-A (sodium sulfite depressant) and 7-B (sodium salt of the condensate of Example 6) are set forth in Table 4.

TABLE 4

| | Flotation Concentrate | |
|---|---|---|
| Ex. | Ash, % | Combustible Recovery, % |
| 6 | 10.5 | 93.5 |
| 6-A | 11.2 | 89.9 |
| 6-B | 12.6 | 89.3 |
| Control | 10.3 | 90.2 |
| 7 | 21.8 | 44.1 |
| 7-A | 24.5 | 42.9 |
| 7-B | 26.0 | 43.0 |
| Control | 25.2 | 42.3 |

What I claim and desire to protect by letters patent is:

1. In the process of separating copper and molybdenum minerals from their associated gangue by subjecting an aqueous pulp of porphyry copper ore to a froth flotation process in the pressence of a gangue depressant and recovering the separated minerals as a flotation froth concentrate, the improvement wherein the depressant is a water-soluble composition consisting essentially of, by weight, (a) from about 95% to about 5% of at least one salt selected from the group consisting of alkali metal sulfite, amonium sulfite, alkali metal bisulfite and ammonium bisulfite and (b) from about 5% to about 95% of at least one salt of a sulfonated compound selected from the group consisting of benzene disulfonic acids, naphthalene disulfonic acids, condensates of formaldehyde and naphthalene sulfonic acids, naphthol sulfonic acids, lignin sulfonic acids and sulfonated quebracho.

2. The process of claim 1 wherein (a) is sodium sulfite.

3. The process of claim 2 wherein (b) is the disodium salt of 1-naphthol-3,6-disulfonic acid.

4. In the beneficiation of ores containing metallic minerals or coal by subjecting an aqueous pulp of said ore or coal to a froth flotation process in the presence of a depressant for associated gangue and ash-producing constituents and recovering the beneficiated minerals or coal as a flotation froth concentrate, the improvement wherein the depressant is a water-soluble composition consisting essentially of, by weight, (a) from about 95% to about 5% of at least one salt selected from the group consisting of alkali metal sulfite, ammonium sulfite, alkali metal bisulfite and ammonium bisulfite and (b) from about 5% to about 95% of at least one salt of a sulfonated compound selected from the group consisting of benzene disulfonic acids, naphthalene disulfonic acids, condensates of formaldehyde and naphthalene sulfonic acids, naphthol sulfonic acids, lignin sulfonic acids and sulfonated quebracho.

5. The process of claim 4 wherein the aqueous pulp is an aqueous slurry of bituminous coal particles.

6. The process of claim 4 wherein the aqueous pulp is an aqueous slurry of anthracite coal fines.

7. The process of claim 4 wherein (a) is sodium sulfite.

8. The process of claim 7 wherein (b) is the sodium salt of a condensate of formaldehyde and naphthalene sulfonic acid.

* * * * *